US007441945B2

(12) United States Patent
Laucella et al.

(10) Patent No.: US 7,441,945 B2
(45) Date of Patent: Oct. 28, 2008

(54) MULTIFUNCTION COAXIAL CORRECTOR DEVICE

(75) Inventors: Vincent Laucella, Le Brassus (CH); Eric Goeller, Les Hôpitaux Vieux (FR)

(73) Assignee: Montres Breguet SA, L'Abbaye (CH)

( * ) Notice: Subject to any disclaimer, the term of this patent is extended or adjusted under 35 U.S.C. 154(b) by 0 days.

(21) Appl. No.: 11/967,901

(22) Filed: Dec. 31, 2007

(65) Prior Publication Data

US 2008/0159081 A1 Jul. 3, 2008

(30) Foreign Application Priority Data

Dec. 29, 2006 (EP) ..... 06127370

(51) Int. Cl.
*G04B 27/02* (2006.01)
*G04B 27/04* (2006.01)

(52) U.S. Cl. ..... 368/190; 368/192

(58) Field of Classification Search ..... 368/190–199, 368/308, 319–321

See application file for complete search history.

(56) References Cited

U.S. PATENT DOCUMENTS

| | | | |
|---|---|---|---|
| 3,837,162 | A | 9/1974 | Meitinger |
| 5,299,177 | A | 3/1994 | Koch |
| 6,918,694 | B2 | 7/2005 | Speichinger et al. |

FOREIGN PATENT DOCUMENTS

| | | |
|---|---|---|
| EP | 1 085 384 A1 | 3/2001 |
| EP | 1 336 907 A2 | 8/2003 |

OTHER PUBLICATIONS

European Search Report issued in corresponding application no. EP 06 12 7370, completed Aug. 14, 2007.

*Primary Examiner*—Vit W Miska
(74) *Attorney, Agent, or Firm*—Griffin & Szipl, P.C.

(57) ABSTRACT

The device includes a single external control member including a pusher (10) whose head (11) and tube (13) are assembled on either side of a control button (15) which can manoeuvre a rack (35). The driving arm (49) of a lever, (45) pivoted at one end of the rack (35), abuts on the pusher tube (13) and the driven arm (51) can be positioned opposite a determined corrector (9*a*) by rotation of the lever (45).

One or several applications of pressure on the pusher (10) activate said corrector (9*a*) by rotation of the lever.

12 Claims, 4 Drawing Sheets

MULTIFUNCTION COAXIAL CORRECTOR DEVICE

This application claims priority from European Patent Application No. 06127370.2 filed Dec. 29, 2006, the entire disclosure of which is incorporated herein by reference.

FIELD OF THE INVENTION

The present invention concerns a multifunction coaxial corrector device for selecting and/or altering the information displayed on a dial by means of a single control member, for example in a timepiece.

BACKGROUND OF THE INVENTION

A timepiece, in particular a wristwatch, allows the user to know the current time, which may be corrected in a known manner by pulling out the winding stem to a determined position.

The wristwatch can also display, alter or start functions "derived" from the current time, such as the date indication, the time zone, chronograph, etc. . . . In order to do this the middle part must also comprise a certain number of push buttons.

By way of non-limiting example, the chronograph watch disclosed in EP Patent No. 1 085 384 may be cited, wherein the middle part includes two push buttons and a winding stem able to occupy three positions.

This raises a certain number of problems for the designers, in particular for making the case, which encloses the heart of the watch, namely the movement, water resistant at that point. The presence of push buttons does not necessarily lead to the sober and elegant attractive appearance sought for top of the range of mid range timepieces.

U.S. Pat. No. 5,299,177 discloses a timepiece, one embodiment of which is an alarm watch including a single external control member on which many different manipulations have to be carried out (traction, pressure, rotation, pause between two manipulations) in order to correct the time, correct the alarm time or check/alter the state of the alarm. This alarm watch is compulsorily fitted with an electronic control circuit and the complexity of the manipulations to be performed constitutes a drawback. Unless he has an excellent memory, the user is practically obliged to permanently carry the instructions with him.

SUMMARY OF THE INVENTION

It is thus an object of the present invention to overcome the drawbacks of the aforecited prior art by providing a device for a timepiece wherein several time or non-time related functions can be activated and/or altered by means of a single control member carried by the middle part, the user also being able to clearly identify the selected function. The device was essentially devised for a mechanical movement, but can be adapted without any difficulty to an electromechanical, or electronic movement.

The invention therefore concerns a multifunction coaxial corrector device for a timepiece for selecting and/or altering a determined function by means of a single external control member located on the middle part for activating the corrector mechanism located inside the case. The device basically includes a pusher formed by a head and a tube assembled on either side of a control button that can be manoeuvred in rotation between two end positions.

The control button drives a control stem whose end includes a drive pinion meshing with the toothing of a rack one end of which includes a lever, whose driving arm is held abutting on a shoulder of the pusher tube and whose driven arm can be positioned by the rack opposite a determined corrector.

Thus, once the selection has been made, which can be marked on the middle part or displayed on the dial, one or several applications of pressure on the pusher head correct the selected function.

According to another slightly more complex embodiment, the connection between the drive pinion and the rack toothing occurs via a sliding pinion that can be moved in a known manner by a pull out piece and a lever when traction is exerted on the control button. This embodiment for example allows the barrel spring of a mechanical movement to be wound, without having to have any other control member on the middle part.

BRIEF DESCRIPTION OF THE DRAWINGS

Other advantages and features of the invention will appear in the following description of various embodiments, given by way of non-limiting illustration, with reference to the annexed drawings, in which.

DETAILED DESCRIPTION OF THE INVENTION

Figure 1:
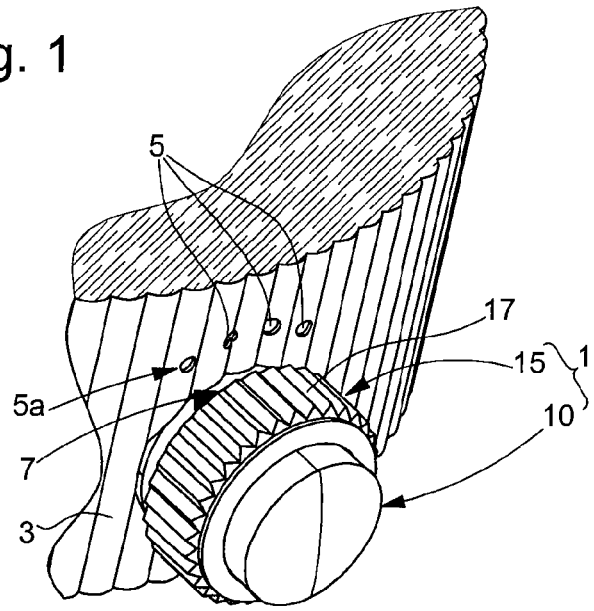
FIG. 1 is a partial perspective view of a corrector device according to the invention.

FIG. 1 shows a portion of the middle part 3 of a timepiece, such as a wristwatch for displaying the current time, in addition to other information that may or may not be linked to the passage of time. As can be seen, middle part 3 includes a single external control member 1, formed by a pusher 10 and a control button 15 able to be manoeuvred at least in rotation with a travel controlled by means of a fluted crown 17, these two elements being assembled coaxially. In this embodiment, control button 15 includes an index 7, which is positioned opposite guide-marks 5 of middle part 3 to let the user know which function he has selected. These guide-marks 5 can be simple marks on the middle part, or may be a pictogram or a symbol more clearly indicating the selected function. One of these guide-marks 5*a* preferably corresponds to a neutral position in which no function is being selected, thus preventing accidental pressure on the pusher from causing an undesired correction. In the example shown, three functions can be selected, such as time-setting, correction of the date, or selection of the chronograph function. It is clear that there could be more or less than three selectable functions, depending upon the designer's choice or the complications of the watch.

According to a variant that is not shown, but the design of which is within the grasp of those skilled in the art, the selected function display can equally be achieved by means of a hand moving in an aperture of the dial, said hand being directly or indirectly driven by a pinion meshed with a rack of the mechanism, which will be better understood with the following description.

This display on the dial can also be achieved by means of another indicator having a kinematic link with the control stem (25) or with the rack (36).

Figure 2:
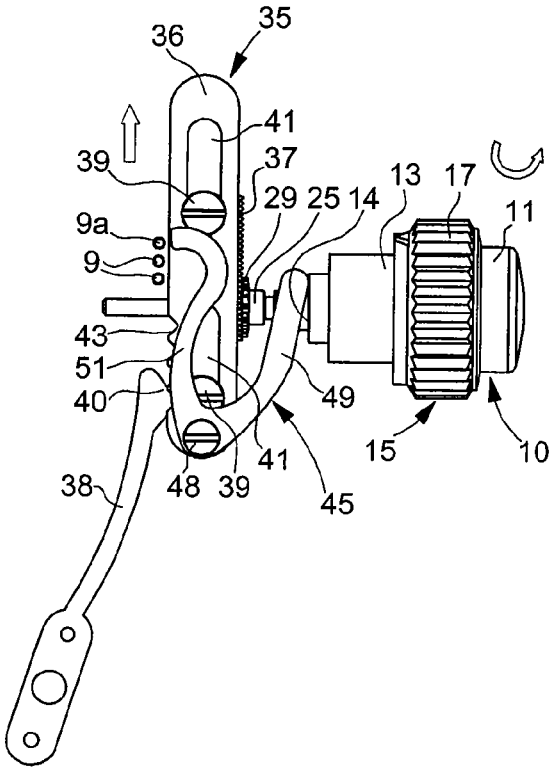
FIG. 2 shows a top view of the corrector mechanism in the "function selection" position, according to a first embodiment.

Referring now to FIGS. 2, 3, 6 and 7, a first embodiment will be described in more detail below. FIG. 2 is a top view limited to the mechanism when a determined corrector 9*a* has been selected by rotating control button 15 using grooved crown 17. The rotation of control button 15 drives a control stem 25 to which a drive pinion 29 with contrate teeth 28 is fixed, meshing with toothing 37 of a rack 35, formed by an elongated plate 36. The travel of rack 35 between two end positions is controlled by two oblong apertures 41 through which two screws 39 pass, screwed into the bottom plate or into a bridge of the movement.

Toothing 37 of rack 35, which allows the travel between these two ends positions, can be extended to drive a pinion for displaying the selected function directly on the dial. It is clear that the drive toothing of said pinion could be located at any other place on rack 35.

A lever 45 pivots on one end of rack 35 by means of a screw 48 fixed in plate 36. Lever 36 includes a driving arm 49 and a driven arm 51 between which there is a pivoting point 47, the lever being, in this example, generally U-shaped, although other shapes are possible. The driving arm 49 is held abutting on inner shoulder 14 of pusher 10 by means of a spring (not shown), which may for example by a helical torsion spring arranged on securing screw 48 of lever 45. The head of the driven arm 51, which includes an end portion 52 bent outwards, is held opposite the selected corrector 9*a* by the cooperation of notches 43 formed, in this example, on one edge of plate 36 opposite that including the toothing of rack 37, and a jumper spring 38 including a beak 40, able to engage in a notch 43. It is clear that those skilled in the art could devise another device for immobilising rack 35, without departing from the scope of the present invention.

Figure 3:
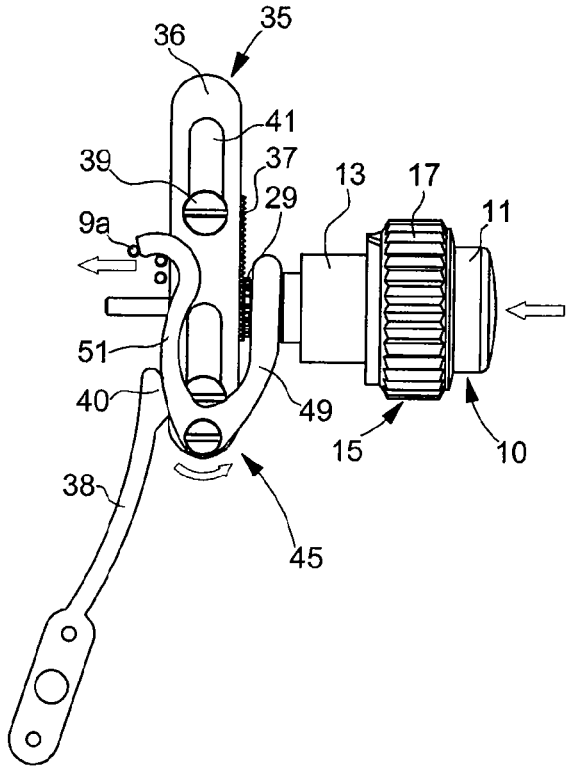
FIG. 3 corresponds to FIG. 2, in the "activation of a function" position.

Once the function has been selected, an application of pressure, or a series of applications of pressure, on the pusher, as shown in FIG. 3, causes lever 45 to pivot such that the driven arm 51 moves to activate said function.

Figure 6:
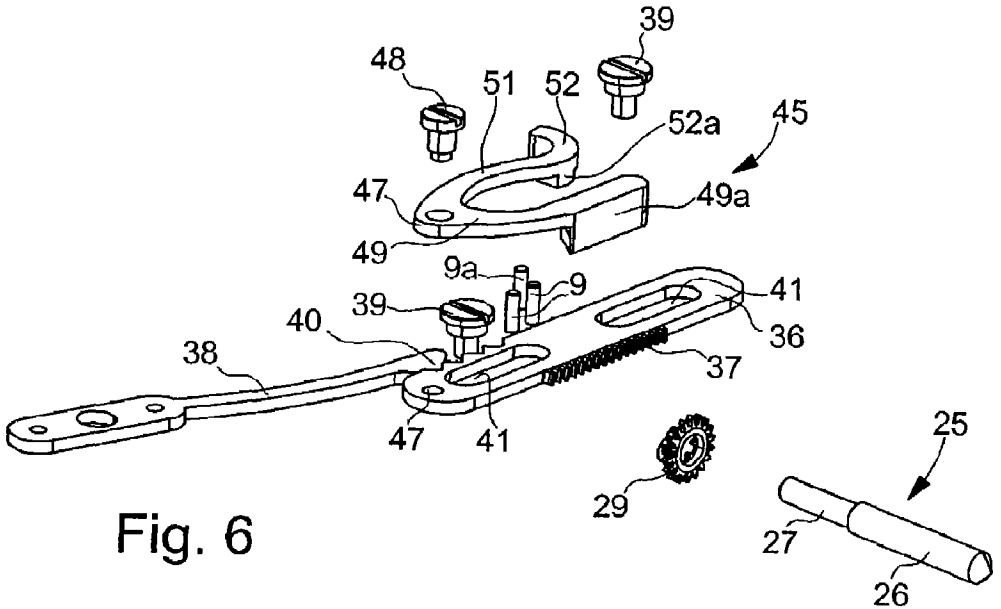
FIG. 6 is an exploded perspective view of the control device according to the first embodiment.

The exploded perspective view of FIG. 6, wherein the same references are used, allows better comprehension of the assembly of the device according to the invention, in addition to other construction details, in particular as regards external control member 1 and the mechanical connection of the same with rack 35.

Figure 7:
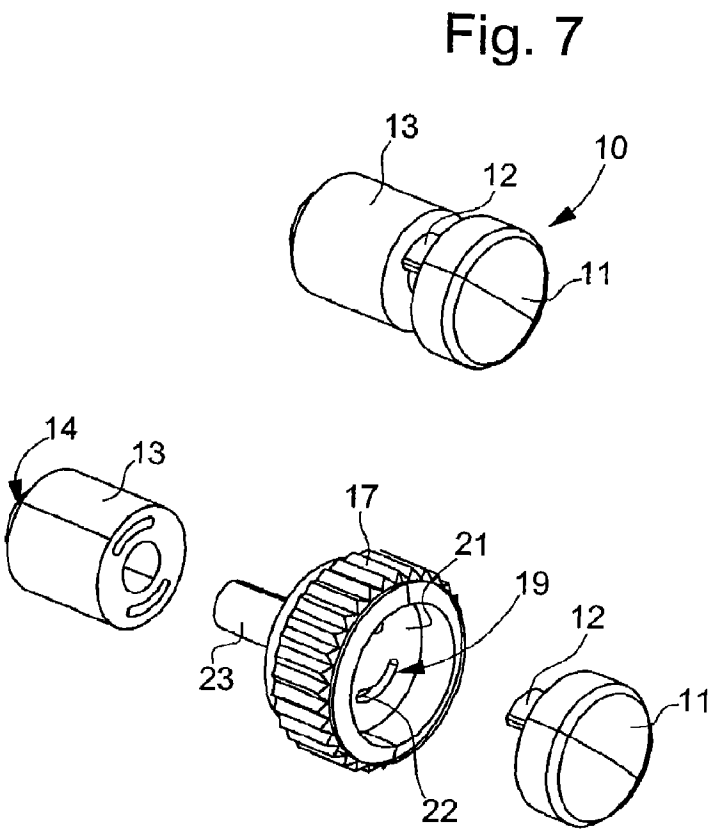
FIG. 7 is a perspective view of the assembled push button.

Pusher 10 is formed by two separate elements, namely a head 11 and a tube 13 to be mounted on either side of control button 15 and then mechanically assembled by means of wings 12 integral with one or other of elements 11, 13, for forming separate parts. This assembly can be achieved by any other means known to those skilled in the art, such as clips or bayonet type assembly. FIG. 7 shows these two elements, as they would be assembled prior to mounting.

For the assembly of the two elements 11, 13 to be possible, control button 15 includes, towards the exterior, a circular recess 19 closed by a bottom 21 for receiving the pusher head 11 and allowing the radial travel of the pusher via pressure on head 11.

Bottom 21 includes two annular holes 22 for the passage of connecting wings 12. The angular aperture of holes 22 and wings 12 is provided such that control button 15 can be manoeuvred in rotation to drive rack 35 between its two end positions, without acting on pusher 10. These angular apertures are provided for allowing an angular displacement of control button 15 of approximately 40°.

Push button 15 further includes a junction member 23 for both the axial positioning of pusher tube 13 and the anti-rotation connection with the end 26 of control stem 25. This connection can be achieved by any means known to those skilled in the art, such as a glued threaded assembly. A drive pinion 29 is mounted in the same way on the other end 27. It will be observed that, in this embodiment, control stem 25 can be integral with junction member 23.

In FIG. 6 it can also be seen that arms 49, 51 of lever 45 include portions of over thickness 49*a*, 51*a* allowing secure contact with shoulder 14 of pusher 10 and correctors 9 respectively.

Figure 4:
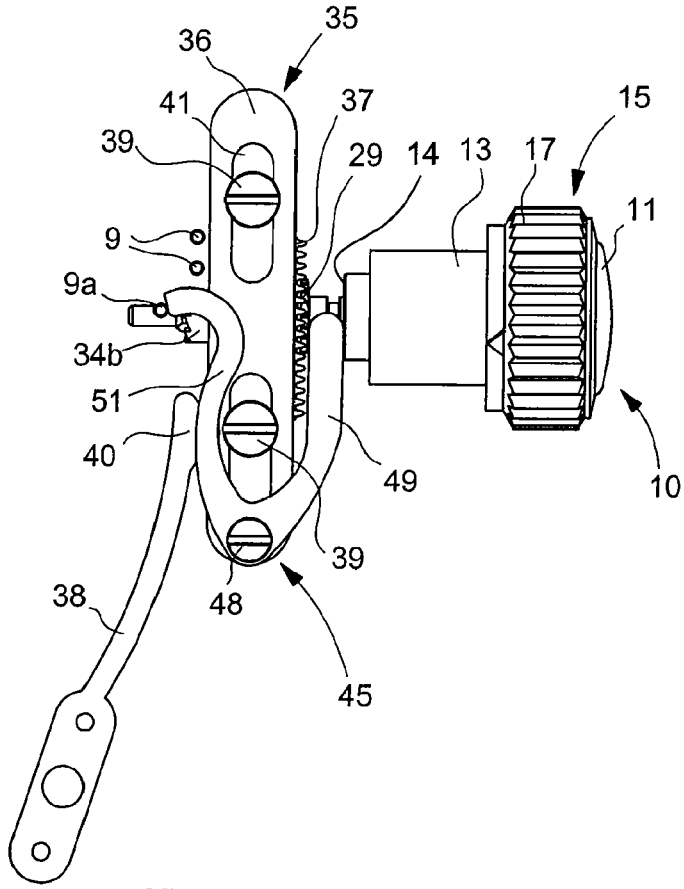
FIG. 4 shows a top view of the mechanism of FIG. 3 for activating another function, according to a second embodiment.
Figure 5:
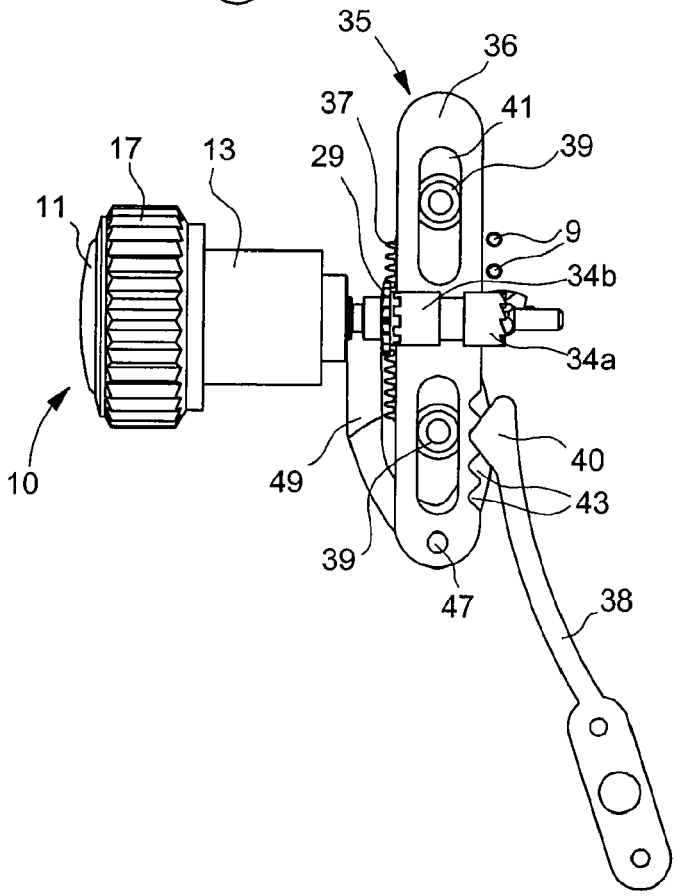
FIG. 5 corresponds to FIG. 4 viewed from above.
Figure 8:
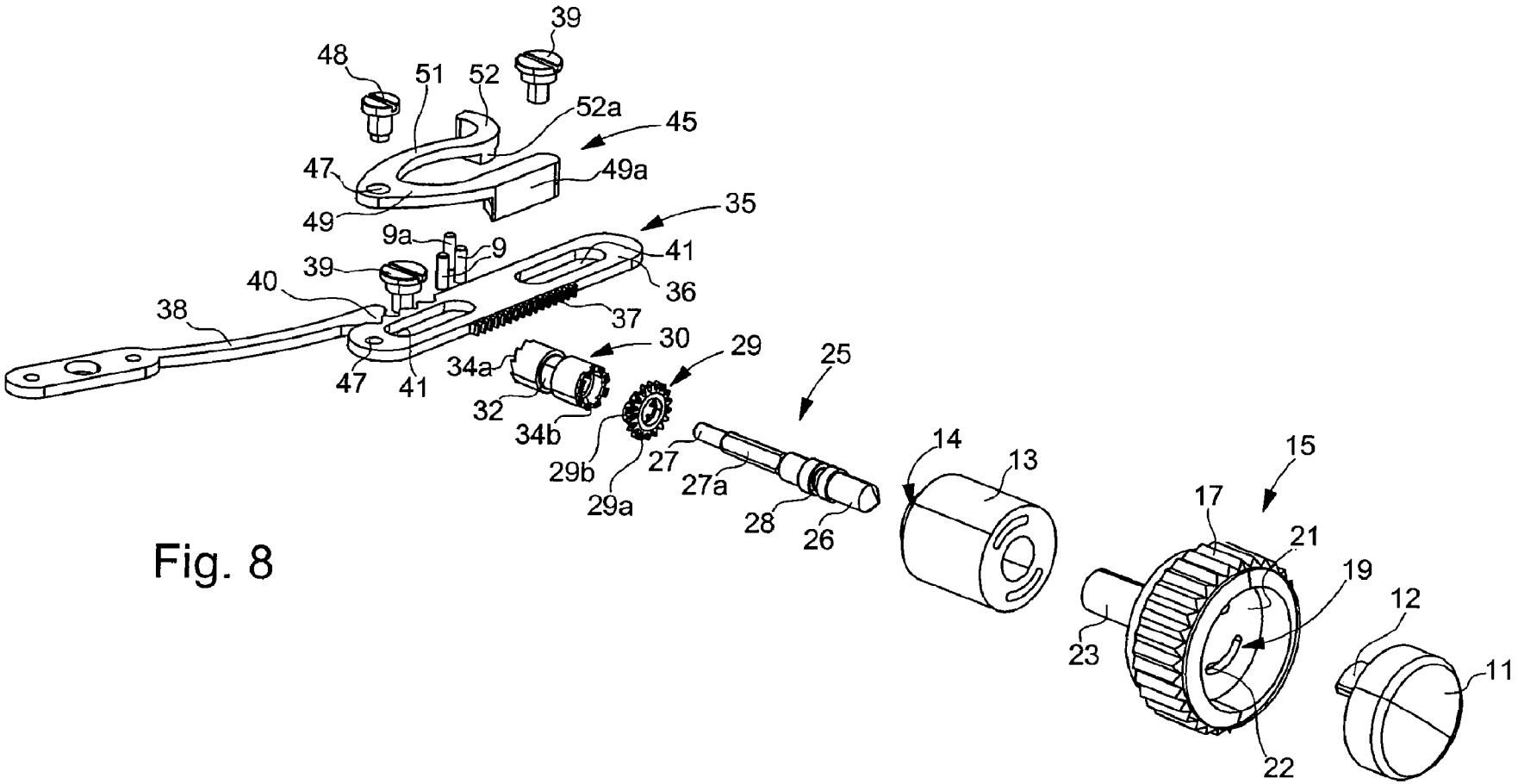
FIG. 8 is an exploded perspective view of the control device according to the second embodiment.

FIGS. 4, 5 and 8 show a second embodiment, which essentially differs from the embodiment that has just been described as regards the connection between rack 35 and control member 1.

This connection is an adaptation of the well known winding/time-setting stem mechanism by means of a sliding pinion 30 via traction and manipulation of the crown. Thus control stem 25 includes in the part 27 thereof oriented towards rack 35, a portion 27*a* of square section, and in the other part 26 thereof, an annular groove 28 in which the arm of a pull-out piece (not shown) engages.

Drive pinion 29 is mounted to rotate freely on a cylindrical part comprised between the square section 27*a* and the part 26 forming the junction with control button 15.

Drive pinion 29 includes, as previously, a ridged toothing 29*a*, but it further includes an annular ridged toothing 29*b* provided for meshing with a corresponding toothing 34*b* of sliding pinion 30.

Sliding pinion 30 includes, in a known manner, an annular groove 32 in which an arm of the lever (not shown) engages, and at the other end a Breguet toothing 34*a* for driving another wheel set of the movement.

In the "function selection" position, pinion 29 is driven indirectly by sliding pinion 30, the assembly being held meshed by the spring of lever 45. When traction is exerted on control button 15, toothings 29*b* and 34*b* are detached and, by moving sliding pinion 30, the lever/pull-out piece device allows toothing 34*a* to mesh with another wheel set of the timepiece movement kinematic chain, for example for winding the barrel spring of a mechanical movement, for setting the time or for any other function.

The preceding description gives two embodiments of a multifunction coaxial corrector device for a timepiece by way of example. It is clear that, without departing from the scope of the present invention, those skilled in the art could devise other variants, for example as regards the mechanical connection between control button 15 and control stem 25 via pusher 10.

The invention claimed is:

1. A multifunction coaxial corrector device for a timepiece for selecting and/or altering a determined function by means of a single external control member located on the middle part, wherein the corrector device includes:

a pusher including a head and a tube;

a control button with a fluted crown including, towards the exterior, a circular recess closed by a bottom;

a control stem secured to the control button;

a drive pinion with a contrate toothing secured directly or indirectly to the control stem via the end thereof;

a rack including a toothing that meshes with the drive pinion; and a lever having a pivoting point on the rack, including a driving arm and a driven arm, and wherein a rotation of the control button, by causing movement of the rack, positions the end of the driven arm of the lever opposite a function corrector, and one or several applications of pressure on the pusher activates the selected function, or alters the selected function, or activates and alters the selected function.

2. The corrector device according to claim 1, wherein the head and the tube of the pusher are formed by two separate parts, assembled on either side of the control button by means of wings passing through holes made in the bottom of the recess of the control button.

3. The corrector device according to claim 1, wherein a cylindrical tube is secured to the bottom of the recess to form the connecting member with the control stem.

4. The corrector according to claim 1, wherein the drive pinion is secured and immobilised in rotation on the control stem.

5. The corrector device according to claim 1, wherein one part of the end of the control stem is provided with a square section, the other end including a pull-out piece groove, and wherein the drive pinion, mounted to rotate freely between the ends, further includes an annular ridged toothing able to mesh with a corresponding toothing of a sliding pinion including a manoeuvring groove via a lever.

6. The corrector device according to claim 5, wherein the sliding pinion includes a second Breguet toothing for meshing with a winding, time-setting or other wheel, when traction is exerted on the control button.

7. The corrector device according to claim 1, wherein the rack has the shape of an elongated plate whose travel is controlled by means of two screws screwed into the bottom plate or into a bridge through oblong apertures in the plate.

8. The corrector device according to claim 1, wherein the rack further includes notches in which the beak of a jumper spring engages to keep the rack in a selected position by means of the control button.

9. The corrector device according to claim 1, wherein the lever is U-shaped, the driving arm is held abutting against a shoulder of the tube of the pusher by elastic means and the driven arm having an end part that bends outwards.

10. The corrector device according to claim 1, wherein the middle part further includes guide-marks opposite which an index, secured to the control button, is positioned.

11. The corrector device according to claim 1, wherein the correction position selected by the control button is displayed on the dial by means of a hand moving in an aperture or any other type of indicator having a kinematic connection with the control stem or with the rack.

12. A timepiece containing a mechanical movement, wherein the timepiece includes a corrector device according to claim 1.

* * * * *